US007198017B2

(12) United States Patent
Vogt et al.

(10) Patent No.: US 7,198,017 B2
(45) Date of Patent: Apr. 3, 2007

(54) INTAKE NOISE SUPPRESSOR

(75) Inventors: Sabine Vogt, Benningen (DE); Juergen Werner, Baltmannsweiler (DE)

(73) Assignee: Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 11/194,550

(22) Filed: Aug. 2, 2005

(65) Prior Publication Data

US 2006/0027204 A1 Feb. 9, 2006

(30) Foreign Application Priority Data

Aug. 5, 2004 (DE) ..... 10 2004 038 216

(51) Int. Cl.
*F02M 35/10* (2006.01)

(52) U.S. Cl. ..... 123/184.57; 181/240

(58) Field of Classification Search ..... 123/184.1, 123/184.57; 181/212, 213, 240, 272
See application file for complete search history.

(56) References Cited

U.S. PATENT DOCUMENTS 3,990,415 A * 11/1976 Malphettes ..... 123/184.57
5,756,945 A 5/1998 Maeda et al.
6,009,705 A 1/2000 Arnott et al.

FOREIGN PATENT DOCUMENTS

DE 196 15 917 A1 10/1997
JP 10-274117 10/1998

* cited by examiner

*Primary Examiner*—Stephen K. Cronin
*Assistant Examiner*—Katrina Harris
(74) *Attorney, Agent, or Firm*—Crowell & Moring LLP

(57) ABSTRACT

An intake manifold 10 in the air intake tract of an internal combustion engine which has a main flow cross section 14 between an oncoming flow side 12 and an outgoing flow side 13. At least one resonator chamber 23 is arranged on the circumference of the main flow cross section 14 in communication with the main flow cross section 14. The resonator chamber 23 is surrounded by side walls 30 and closed by a cover 28, with the side walls 30 of the resonator chamber 23 and the wall 15 forming the main flow cross section 14 being manufactured together in one piece. A parting plane 31 situated between the cover 28 and the side walls 30 of the resonator chamber 23 is arranged outside of the wall 15 forming the main flow cross section 14.

7 Claims, 2 Drawing Sheets

INTAKE NOISE SUPPRESSOR

BACKGROUND OF THE INVENTION

This invention relates to an intake manifold having a main flow channel and at least one resonator chamber disposed thereon in communication with the main flow channel.

Intake manifolds having noise suppressing attributes are used in the air intake tract of internal combustion engines between the unfiltered air inlet and the cylinder head of the internal combustion engine. Due to the charge cycle of the internal combustion engine, there is a pulsation of air which produces vibration in the intake system and results in unwanted acoustic and mechanical stresses.

U.S. Pat. No. 6,009,705 (=EP 859,906) describes a noise suppressor having multiple resonator chambers between a gas inlet and a gas outlet. The tubular resonators and the flow cross section are formed by joining two housing parts. A parting plane runs between the two housing parts along the housing walls of the individual resonators and the main flow cross section.

One disadvantage of this embodiment is that when the housing walls are joined together, a large connecting area must be closed and sealed. This connecting area is responsible for a high manufacturing cost and interrupts a smooth course of the pipe wall. In addition, a resonator having this design must rely on a large flat area as the installation space.

SUMMARY OF THE INVENTION

It is an object of the present invention to provide an improved air intake noise suppressor.

Another object of the invention is to provide an intake noise suppressor which can be variably adapted to the available installation space.

A further object of the invention is to provide an intake noise suppressor which can be manufactured easily, reliably and economically.

These and other objects are achieved in accordance with the present invention by providing an intake manifold for an air intake tract of an internal combustion engine, the manifold having a main flow cross section situated between an oncoming flow side and an outgoing flow side, at least one resonator chamber arranged on and communicating with the periphery of the main flow cross section, the resonator chamber being surrounded by side walls and closed by a cover, and the side walls of the resonator chamber and the wall forming the main flow cross section being manufactured in one piece, and a parting plane between the cover and the side walls of the resonator chamber being situated outside of the wall forming the main flow cross section of the manifold.

The intake manifold according to the invention serves to guide the air and provide a defined damping of the pulsation frequencies occurring in the air intake tract of an internal combustion engine. The intake manifold has an oncoming flow side which may be connected to an unfiltered air pipe, an air filter housing or an intermediate flange. The outgoing flow side is preferably connected to a throttle valve, to a clean air pipe or to an intake manifold leading to the cylinder head. The intake manifold of the invention may be positioned upstream or downstream from the air filter in the direction of flow or directly at the intake mouth. Connections at the oncoming and outgoing flow sides are preferably sealed by resilient intermediate flanges and are attached by clamps, clamping elements or connecting elements known from the state of the art.

The main flow cross section is formed between the oncoming flow side and the outgoing flow side, and all of the air mass taken in by the internal combustion engine flows through this cross section. The walls of the main flow cross section are preferably hollow cylinders and separate the cross section from a resonator and from the ambient side of the intake manifold.

On the periphery and corresponding to the main flow cross section, a connecting opening branches off toward the side of the resonator. The resonator is surrounded by side walls which transition into the walls of the main flow cross section over their entire extent.

The intake manifold is manufactured in at least two parts from a base body and at least one cover. The base body forms the main flow cross section and a part of the resonator chamber. The cover seals the resonator chamber relative to the ambient environment. In the simplest embodiment, the cover is a flat disk which at its peripheral contour is connected in a sealed manner to the side walls of the resonator.

This connection between the cover and the side walls of the resonator forms a parting plane. The connection is preferably welded, but it may also be formed, e.g., by gluing or by other techniques known in the art. Due to the complete transition of the side walls of the resonator at the periphery into the walls of the main flow cross section, the parting plane is outside of the walls of the main flow cross section. The wall of the main flow cross section can be manufactured without any tangent parting plane. The intake manifold and the cover can be manufactured by an original forming method, in particular by an injection molding method. Suitable materials include, for example, polypropylene or polyamide [nylon].

This arrangement advantageously ensures that none of the contour formed by the connection, e.g., a glue bulge or welding bulge, protrudes into the flow cross section, leading to increased flow resistance. Due to the fact that the parting plane is in the resonator area, this yields a greater design freedom in designing the resonator chamber. Since there is no weld connection in the wall of the main flow cross section, it has an increased mechanical stability. This is particularly advantageous at the connections of the oncoming flow side and the outgoing flow side to the air intake tract that are under stress.

In one advantageous embodiment of this invention, a plurality of resonators are provided on the intake manifold, with the resonators optionally being arranged side by side or nested one inside the other. Resonators arranged side by side may be separated from one another by common partitions and may have surrounding side walls which separate them from the surrounding ambient environment. They may be closed by a common cover or by multiple covers. It is also possible to arrange the resonators side by side independent of each other, in which case each resonator has an individual peripheral side wall surrounding which separates it from the surrounding ambient environment. If desired, the resonators and/or the intake manifold may be joined together by ribs in order to provide increased mechanical stability.

The resonators may also be nested, in which case the resonators may mutually enclose one another either entirely or in part. Partitions provided between the resonators form an inner side wall for a resonator on the outside and form an outer side wall for a resonator on the interior. Resonators arranged one inside the other are preferably closed by a common cover. The side walls may be arranged substantially parallel to one another, so that they can be manufactured as a single molded part. In an advantageous manner, different resonator volumes can be produced easily and economically by using a plurality of multiple resonators. Due to the fact that the side walls are used in multiple ways, this yields an advantageous use of the design space and weight savings.

In another advantageous embodiment of this invention, the cover has side walls which mate with the side walls of the resonators so that the cover forms part of the resonator chamber. If the resonator chamber side walls on the intake manifold are nested one within another, then the mating side walls on the cover may also be similarly nested. The cover need not be flat but may also be constructed with a curved or stepped configuration. The variable design options for the cover are a positive aspect of this embodiment because they make it possible to adapt the configuration of the resonator chamber(s) and/or manifold to a variety of spatial requirements.

In accordance with another advantageous embodiment of this invention, the resonators are arranged so they are offset around the circumference of the main flow cross section. The branches to the channel of the resonator are situated in the direction of flow, e.g., on a plane. The resonators may be arranged opposite one another or offset at any desired angle to one another. Such an arrangement makes it possible to advantageously design a short intake manifold having a plurality of resonator chambers. Due to a uniform distribution of resonators around the circumference, the center of gravity of the intake manifold may be located within the main flow cross section, so that the mounting complexity for the intake manifold can be reduced.

In addition, it may be advantageous to arrange the resonators so they are offset in relation to one another in the direction of flow. This is necessary in cases where the available peripheral space is not sufficient for the required resonance volume and a longer space is available for the intake manifold. If multiple resonators are arranged on a longitudinal side of the intake manifold, then the center of gravity of the intake manifold is situated on the resonator side. In this case, it is advisable to arrange fastening contours on the resonators. These include, for example, eyes, ribs, indentations or screw caps. The fastening contours may also be formed by the shape of the mold, or manufactured as an insert part in conjunction with the intake manifold and/or the cover or welded or glued to the intake manifold. The arrangement with the offset in the direction of flow offers the advantage of adapting a plurality of resonators to an elongated installation space and sealing all of them with one cover.

In another advantageous embodiment, the resonators are constructed as quarter wave resonators and/or as Helmholtz resonators. Due to the combination of the two types of resonators, this yields a very advantageous utilization of the design space so that various acoustic tasks can be accomplished.

In accordance with another advantageous embodiment of this invention, the parting plane between the cover and the side walls of the resonator chamber is designed to be curved or stepped. The parting plane thus may close off several resonators arranged adjacent one another around the circumference or one after the other in the direction of flow. A parting plane designed in this way makes it possible to use a single cover to close off several resonators having different radial distances or spacings from the wall of the main flow cross section.

In one advantageous embodiment, the resonators are arranged opposite one another on the circumferential side of the main flow cross section. In the case of two resonators arranged in this way, they are preferably aligned at an angle of 180° from one another. In the case of more than two resonators, the angle offset is divided evenly. The individual resonators may each contain multiple resonator chambers. This design forms an advantageous symmetrical intake manifold with a centrally located center of gravity and increased static stability.

These and other features of preferred embodiments of the invention, in addition to being set forth in the claims, are also disclosed in the specification and/or the drawings, and the individual features each may be implemented in embodiments of the invention either alone or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to illustrative preferred embodiments shown in the accompanying drawing figures, in which.

DETAILED DESCRIPTION OF PREFERRED EMBODIMENTS

Figure 1:
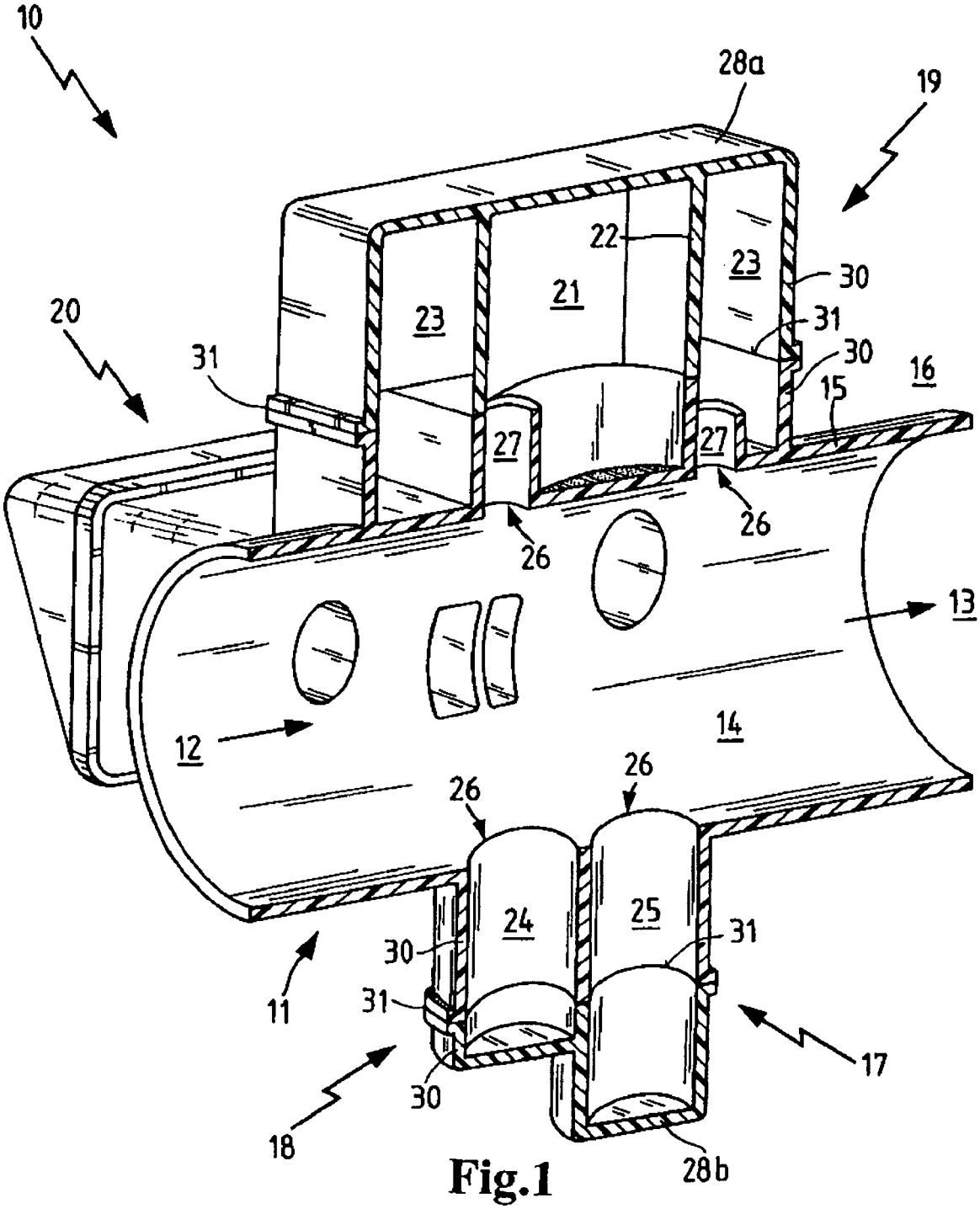
FIG. 1 is a sectional, perspective view of an intake manifold according to the invention.

FIG. 1 shows an intake manifold 10 in a fully sectional perspective view, which has a main flow cross section 14 between an oncoming flow side 12 and an outgoing flow side 13 on a base body 11. The oncoming flow side 12 and the outgoing flow side 13 are connected to components of an air intake tract (See FIG. 2). These connections are preferably designed to be round or oval and may be attached and sealed, for example, by elastomer couplings. The components to be joined may include, for example, throttle valves, clean air pipes, intake manifolds, unfiltered air pipes and/or air filters.

The main flow cross section 14 is surrounded by walls 15. The walls 15 separate the main flow cross-section 14 from the surrounding ambient environment 16 and from the resonators 17, 18 and 19.

The resonators include two quarter-wave resonators 17, 18, a double resonator 19 and a multiple resonator 20 which is not shown in cross section. The double resonator 19 forms two Helmholtz resonators which are nested. An inner resonator chamber 21 is separated by a partition 22 from an outer resonator chamber 23. The outer resonator chamber 23 encloses the inner resonator chamber 21 around the full circumference. All the resonator chambers 21, 23, 24, 25 shown here communicate with the main flow cross section 14 through connecting openings 26. The resonator chambers 21, 23, 24, 25 are closed off in a sealed manner relative to the surrounding ambient environment 16 by the covers 28*a*, 28*b* and the side walls 30. A portion of the side walls 30 comprise parts of the covers 28 and 29, and another portion of the side walls is arranged on the base body 11. The parting planes 31 at which the covers 28 and 29 are tightly connected to the base body 11 extend transversely through side walls 30. These joints are preferably formed by adhesive connection or by welding, but may also be established through the use of screws or latching connections.

Connecting channels 27 having reduced cross-sectional areas in comparison with the resonators 21 and 23 are provided between the resonator chambers 21, 23 and the connecting openings 26 on the Helmholtz resonators. The connecting channels 27 may also be adjacent to the side walls 30 and may use these side walls as a wall.

The quarter-wave resonators 17, 18 are depicted as essentially tubular, cylindrical volumes which are defined in part by side walls 30 on the base body 11 and in another part by side walls 30 of the cover 28*b*. The resonator chambers 24, 25, which are depicted as be essentially cylindrical, may also be formed in any desired cross-sectional shape and may be arranged in combination with other resonators. The quarter-wave resonators 17, 18 may also be arranged in a curved or angled fashion on the intake manifold 10.

Figure 2:
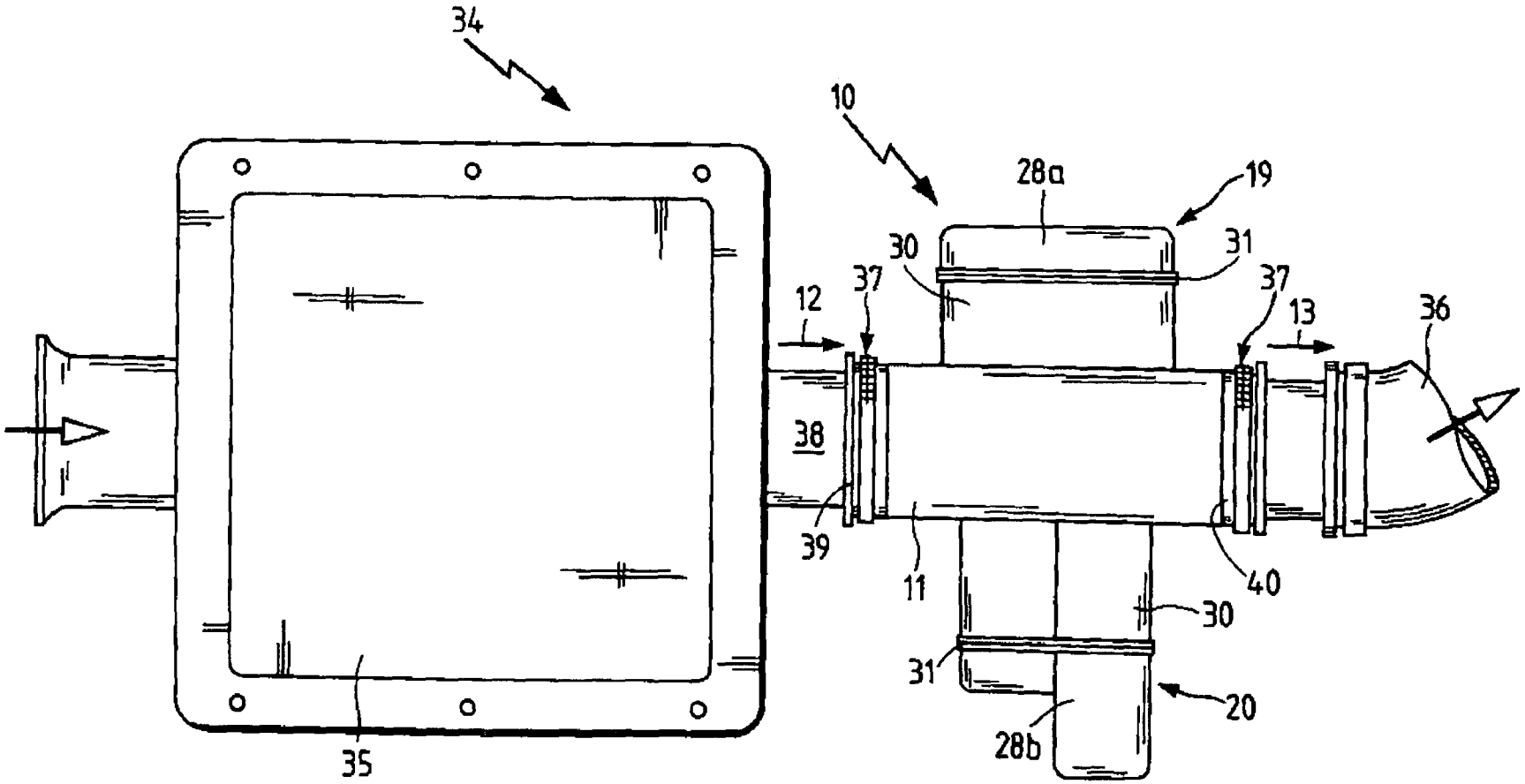
FIG. 2 is a diagram of the intake manifold of FIG. 1, installed in an air intake system.

FIG. 2 shows an intake manifold 10 which is installed in an intake system 34. Components corresponding to those in FIG. 1 are identified by the same reference numerals. The intake manifold 10 is connected on the oncoming flow side 12 to an air filter 35 and on the outgoing flow side 13 to a clean air pipe 36. A hollow cylindrical clean air nipple 38 on the air filter 35 is thereby engaged in an oncoming flow stem 39 on the intake manifold 10. On the outgoing flow side 13, the discharge flange 40 on the intake manifold 10 is engaged with the clean air pipe 36. These two connections are secured by clamping elements 37. The side walls 30 are constructed in one piece on the base body 11. The resonators 19 and 20 are formed from the side walls 30 and the covers 28*a* and 28*b*. The side walls 30 are connected to the covers 28*a* and 28*b* at parting planes 31.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. An intake manifold for an air intake tract of an internal combustion engine, said manifold having a main flow cross section situated between an oncoming flow side and an outgoing flow side, at least one resonator chamber arranged on and communicating with the periphery of the main flow cross section, said resonator chamber being surrounded by side walls and closed by a cover, and the side walls of the resonator chamber and the wall forming the main flow cross section being manufactured in one piece, wherein a parting plane between the cover and the side walls of the resonator chamber is situated outside of the wall forming the main flow cross section of the manifold and wherein a plurality of resonator chambers are arranged adjacent one another or nested one inside another, and the resonator chambers are closed off by one or more covers.

2. An intake manifold according to claim 1, wherein the cover comprises resonator side wall portions which mate with resonator side wall members formed on the main flow cross section of the intake manifold.

3. An intake manifold according to claim 1, wherein a plurality of resonator chambers are arranged offset around the circumference of the main flow cross section.

4. An intake manifold according to claim 1, wherein a plurality of resonator chambers are arranged longitudinally offset from one another along the main flow cross section.

5. An intake manifold according to claim 1, wherein the resonator chambers are constructed as Helmholtz resonators or quarter-wave resonators or both.

6. An intake manifold according to claim 1, wherein the parting plane has a curved or stepped configuration.

7. An intake manifold according to claim 1, wherein the resonator chambers are arranged opposite one another around the circumference of the main flow cross section.

* * * * *